United States Patent [19]

Fiore

[11] Patent Number: 4,550,458

[45] Date of Patent: Nov. 5, 1985

[54] CERVICAL SUPPORT PILLOW

[76] Inventor: John W. Fiore, 7240 Lem Turner Rd., Jacksonville, Fla. 32208

[21] Appl. No.: 550,804

[22] Filed: Nov. 14, 1983

[51] Int. Cl.[4] ..... A47C 20/00

[52] U.S. Cl. ..... 5/434; 5/436; 297/393

[58] Field of Search ..... 5/434–437; 297/393

[56] References Cited

U.S. PATENT DOCUMENTS

| | | | |
|---|---|---|---|
| 1,386,652 | 8/1921 | Patton | 5/437 |
| 1,580,210 | 4/1926 | McCulloch | 5/436 |
| 2,336,707 | 12/1943 | Thompson | 5/436 |
| 2,522,120 | 9/1950 | Kaskey | 5/436 |
| 3,009,172 | 11/1961 | Eidan | 5/436 |
| 3,312,987 | 4/1967 | Emery | 5/436 |
| 3,521,310 | 7/1970 | Greenawalt | 5/436 |
| 4,034,748 | 7/1977 | Winner | 5/434 |
| 4,218,792 | 8/1980 | Kogan | 5/436 |

*Primary Examiner*—Gary L. Smith
*Assistant Examiner*—Michael F. Trettel
*Attorney, Agent, or Firm*—Arthur G. Yeager

[57] ABSTRACT

A cervical support pillow having a generally semicircular cutout portion extending from the top edge to the central portion of the pillow, and two small sectorial cutout portions extending from the bottom edge to the central portion of the pillow, the two small cutout portions being spaced apart from each other by a cervical support portion between the two cutout portions. This pillow is intended for use when resting or sleeping.

19 Claims, 15 Drawing Figures

CERVICAL SUPPORT PILLOW

BACKGROUND OF THE INVENTION

It is well known that many persons suffer from pains in the back, neck, and shoulders because of poor posture or from long periods of leaning over a desk or table in a particular occupation. The area of the seventh cervical vertebra of the spine is placed under stress when the head is bent one way or the other, and if such stress is maintained over a long period of time, one or more spinal discs in that cervical area will be displaced posteriorly and engage spinal nerves or the spinal chord causing pain and discomfort. A discussion of such matters is found in The Journal of Clinical Chiropractic, Vol. 1, No. 4, 1974, pages 16–33 in an article by John Fiore entitled "Discaltic Aberrations of the Spine."

Several prior art workers have suggested various designs of pillows to relieve neck strain, for example, U.S. Pat. No. 2,336,707 to Thompson; U.S. Pat. No. 2,700,779 to Tolkowsky; U.S. Pat. No. 2,940,088 to Boos; and U.S. Pat. No. 3,243,828 to McCarty. While these disclosures show pillows which may be of help in relieving neck strain, they do not provide the best design for maximum all around use in reducing displaced cervical discs.

It is an object of this invention to provide an improved pillow to support the area of the seventh cervical vertebra. It is another object of this invention to provide an improved cervical support pillow which can be used when sleeping. Still other objects will be apparent from the more detailed description of this invention which follows.

BRIEF DESCRIPTION OF THE INVENTION

This invention provides a flexible resilient pillow to support the cervical area of one using the pillow, said pillow having a central body terminated by a top edge and a bottom edge generally parallel to each other, a large generally semicircular cutout section extending from said top edge into said body and adapted to receive the back of the head of the user, two small, spaced, sectorial cutout sections extending from said bottom edge into said body and adapted to fit over the shoulders of the user, the said three cutout sections being genrally symmetrical about an axis through said body and perpendicular to said top edge and said bottom edge.

In a preferred embodiment of this invention the two small cutout sections are separated by a central cervical support portion which is stiffer than the remaining portions of the pillow. In still another preferred embodiment of this invention the pillow is large enough laterally to wrap around the back and sides of the head of the user, with recesses for the user's ears, and with means connecting the two lateral edges of the pillow to each other to hold the pillow in place around the back and the two sides of the user's head. In a preferred embodiment the pillow is shaped identically on its top and bottom surfaces.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
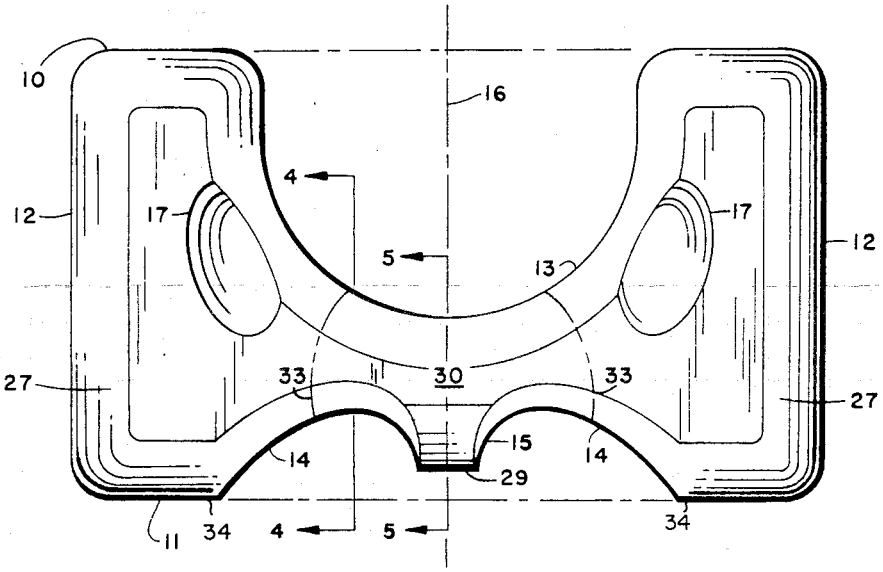
FIG. 1 is a top plan view of the pillow of this invention.
Figure 2:
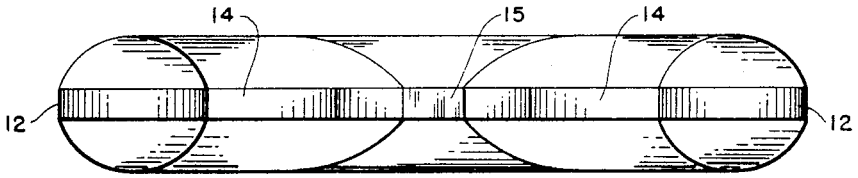
FIG. 2 is a rear elevation view of the pillow of this invention.
Figure 3:
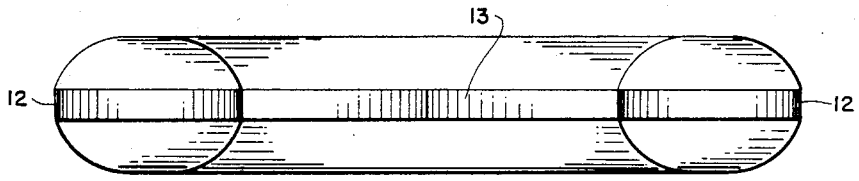
FIG. 3 is a front elevation view of the pillow of this invention.
Figure 5:
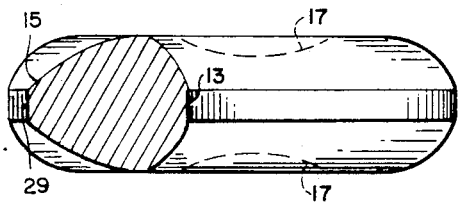
FIG. 5 is a cross-sectional view taken at 5—5 of FIG. 1.
Figure 4:
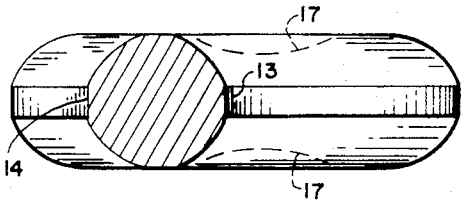
FIG. 4 is a cross-sectional view taken at 4—4 of FIG. 1.

The pillow of this invention can be seen in detail in FIGS. 1–5. The pillow is a rectangular article that has cutout portions removed therefrom to leave an irregular symmetrical shape having a rough similarity to a bow tie in the sense that the central body portion is small and two lateral side or wing portions are large. The pillow has a top edge 10, a bottom edge 11, and two side edges 12. There are three cutout portions, 13 and 14, which are positioned symmetrically about central axis 16 which is perpendicular to top edge 10 and bottom edge 11 and extends through the center portion 30 of the pillow parallel to edges 12 and midway between edges 12. Two lateral wing portions 27 adjoin central portion 30 of the pillow.

Cutout portion 13 is roughly semicircular in shape with the linear portion of the semicircle on top edge 10 and the curved portion of the semicircle extending into central portion 30 of the pillow symmetrically about axis 16. This cutout portion 13 is intended to fit generally around the back of the head and neck of the user of the pillow.

Immediately below the lowest portion of cutout 13 is a central support portion 33 including cervical support member 15 with cutout portions 14 on both sides thereof. The cutout portions are generally sectorial, preferably parabolic, in shape with the apex of the curve in the central portion 30 of the pillow and the open portion of the curve along bottom edge 11. Support member 15 is intended to lie over the portion of the spine at the base of the neck known as the seventh cervical vertebra. Member 15 terminates short of bottom edge 11 and is tapered from the overall thickness of the pillow in central portion 30 to a thinner section at its bottom edge 29. The lateral width of edge 29 is only enough to cover the spine, i.e. 2–3 inches. The shape of cutout portions 14 is intended to accommodate the tops of the shoulders of the user when the pillow is wrapped around the back and sides of the head of the user. In order to accommodate the ears of the user when the pillow is in its wrap-around position, recesses 17 may be hollowed out from one or both surfaces of wing portions 27 of the pillow. If desired, recesses 17 may be formed in both surfaces (as in FIGS. 4 and 5), so the reversible pillow may be used with either surface touching the head of the user.

Figure 7:
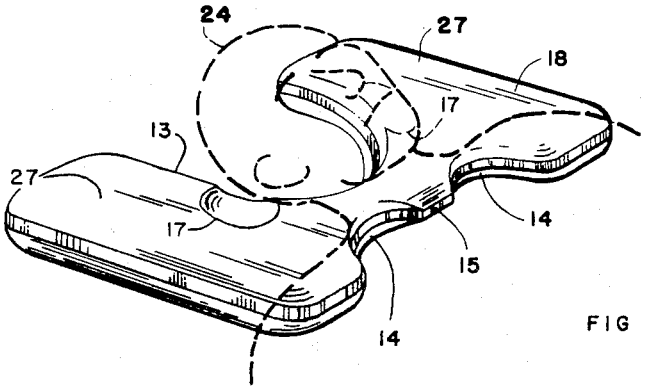
FIG. 7 is a perspective view of the pillow of this invention placed flat under the head of a user.

In FIG. 7 pillow 18 of this invention is shown lying flat and supporting the head and shoulders of the user 24 when lying in the supine position. Cutout area 13 lies around the head of user 24 and support pad 15 is directly under the seventh cervical area of the spine. Wing portions 27 extend laterally from the head of user 24.

Figure 7A:
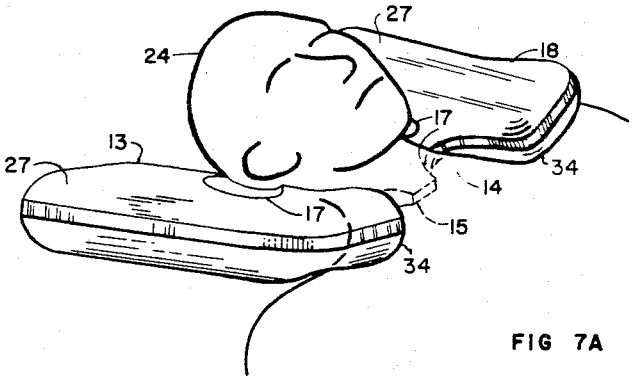
FIG. 7A is the same as FIG. 7 with the lower corners of the pillow moved forward to be adjacent the chest of the user.

In FIG. 7A corner portions 34 formed by bottom edge 11 and side edges 12 is brought forward of the shoulders of the user so as to be adjacent the chest of the user. This position partially wraps the pillow around the head and applies pressure through support member 15 to the seventh cervical vertebra and adjacent portions of the neck to provide relief from neck strain.

Figure 6:
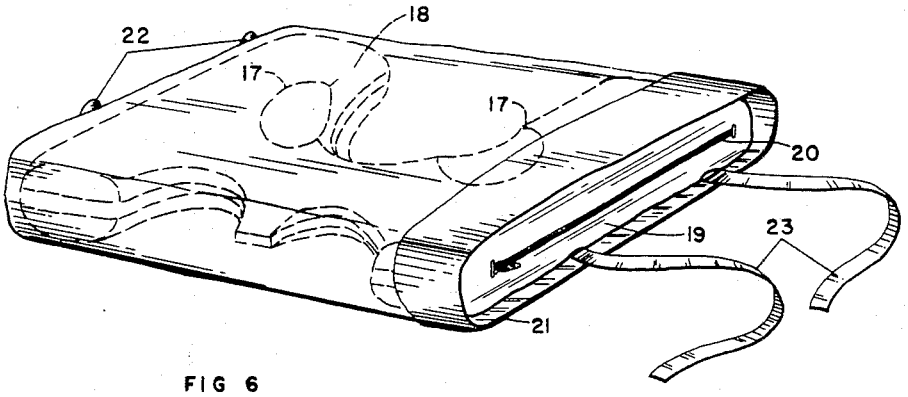
FIG. 6 is a perspective view of the pillow of this invention encased in a slip cover and a pillowcase.

In FIG. 6 there is shown pillow 18 covered with a slip cover 19 having a zipper 20 through which pillow 18 can be inserted into cover 19 and closed to form a total enclosure of a fabric cover over pillow 18. The resulting covered pillow is then covered with a pillow case 21 before use so as to keep pillow 18 clean. In the embodiment shown here there are two buttons 22 attached to the one end of pillow case 21 and two corresponding tie strips 23 attached to the other end of pillow case 21. These ties and buttons are used to hold the pillow in a wrap-around position as shown in FIG. 8.

Figure 8:
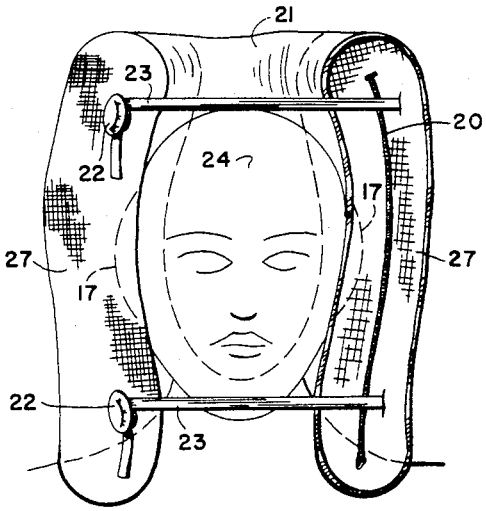
FIG. 8 is a front view of the pillow of this invention wrapped around the user's head.

When it is desired to wrap pillow 18 around the head of user 24 as shown in FIG. 8, the two lateral wing portions 27 are wrapped around the sides of the head of user 24 with the ears fitting into recesses 17. Tie strips 23 are tied to buttons 22 to hold pillow 18 in its wrap-aound position.

Figure 9:
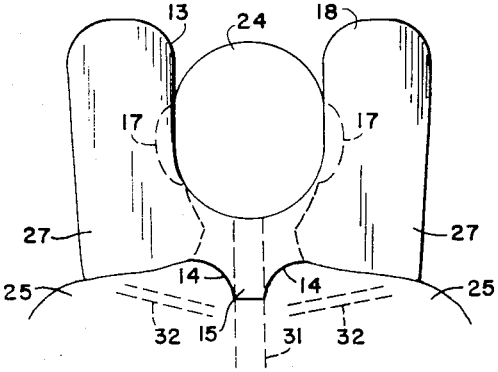
FIG. 9 is a rear view of the pillow of this invention in place on the head of the user.
Figure 10:
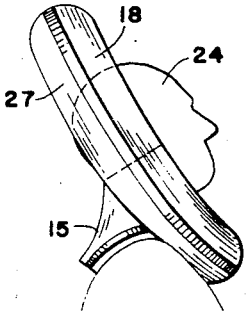
FIG. 10 is a side view of the pillow and user of FIG. 9.

In FIGS. 9 and 10 pillow 18 is shown in a position intermediate between the positions shown in FIGS. 7 and 8, which position is expected to be the primary position for use of this pillow. In this position the user has member 15 over the area of the seventh cervical vertebra at the junction of the spine 31 and shoulder bones 32 with the back of the head in cutout portion 13 and lower parts of wing portions 27 along bottom edge 11 are placed forward of shoulders 25 of user 24. In this way member 15 is in position to apply supporting pressure to the vertebra in the cervical area when the user leans back against a chair or lies in bed on his back. Cutout portions 14 are necessary to permit this arrangement of pillow 18.

Figure 11:
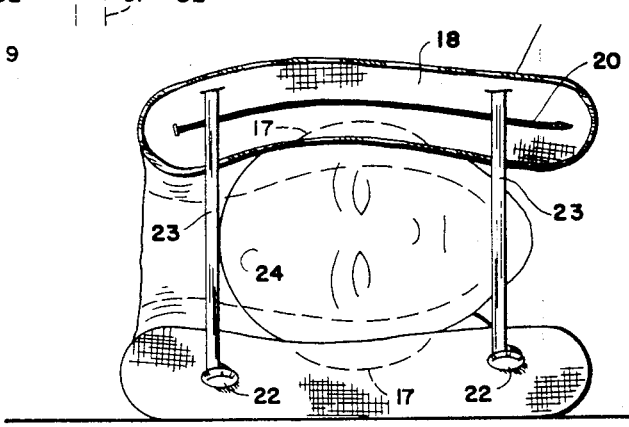
FIG. 11 is a front view of the pillow and user of FIG. 8 when the user is lying on his side.
Figure 12:
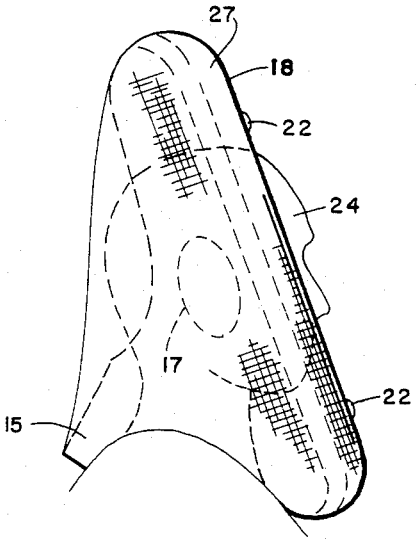
FIG. 12 is a side view of the pillow and user of FIG. 8.
Figure 13:
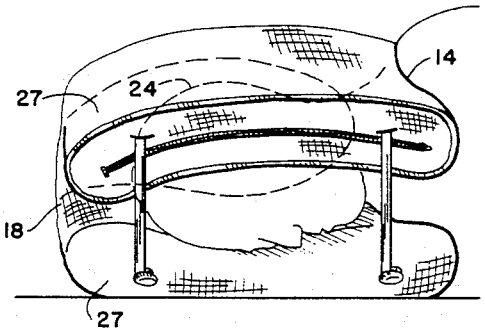
FIG. 13 is a view of the pillow and user of FIGS. 8, 11 and 12 with the user facing somewhat downwardly.
Figure 14:
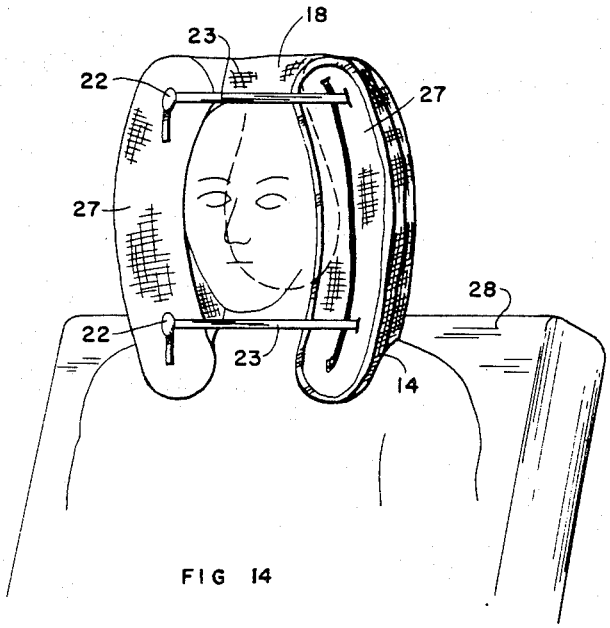
FIG. 14 is a perspective of the pillow and user of FIG. 8 when the user is sitting in a chair.

In FIGS. 11–14 there are shown the various positions the user may take when wearing pillow 18 in the wrap-around arrangement with tie strips 23 fastened to buttons 22 and the user's ears in recesses 17. In FIG. 11 it is seen that the user could lie on either side in the horizontal position as in bed. In FIG. 12 it is seen how pillow 18 an be worn when user 24 is standing or sitting. In FIG. 13 it is seen that user can lie in the prone position, face partially downward, and be supported by the pillow. In FIG. 14 it is seen how user 24 could be seated in chair 28 while wearing the pillow in its wrap-around arrangement and by leaning back apply pressure to the cervical spinal area through member 15.

One of the preferred constructions is for pillow 18 to be made of a solid synthetic plastic or elastomeric foam, such as polyurethane. Such a material is made in a wide variety of stiffness or softness. It is particularly desirable if member 15 and the surrounding control support portion 33 is made in a stiffer construction than the remainder of pillow 18, thus providing a suitable pressure application zone for the cervical area and a desirable softness for the remainder of the pillow. A numerical description which is employed to measure such relative stiffness or softness is known in the industry as I.F.D. (Indent Force Deflection). A suitable softness is 10–20 I.F.D. for most of pillow 18 while a suitable stiffness for pad 15 is 30–40 I.F.D. The normal pillow is about 14×22 inches and about 4 inches thick.

The pillow of this invention is principally designed for use in applying pressure to the cervical area to relieve the pain of one or more displaced spinal discs. The pillow, however, has other advantages. It can serve to muffle or eliminate annoying noises that may inhibit peaceful sleeping. It can hold a hairdo in place that might otherwise be destroyed during the many head movements during a period of sleeping. The pillow can, of course, be worn while riding in an automobile, watching television, exercising the body, sleeping, etc.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A flexible resilient pillow to support the cervical area of one using the pillow, said pillow having a central body terminated by a top edge and a bottom edge generally parallel to each other, a generally semicircular cutout section extending from said top edge into said body and adapted to receive the back of the head of the user, a pair of spaced sectorial cutout sections extending from said bottom edge into said body and adapted to fit over the shoulders of the user, said three cutout sections being generally symmetrical about an axis through said body and perpendicular to said top and bottom edges, said pillow having a narrow portion between said pair of cutout sections and terminating spacedly above and adjacent said bottom edge, said narrow section being pressed against the area of the back adjacent the seventh cervical vertebra of the user, said pillow further comprising a pair of spaced lateral wing portions extending laterally along said bottom edge from respective said pair of cutout sections to the lateral edges of said pillow, said wing portions adapted to extend forwardly of the respective shoulders of a user and thereby to apply anterior pressure onto said narrow portion and to apply a force against the cervical area of the back and the adjacent seventh vertebra restraining the spinal discs of the user from bulging.

2. The pillow of claim 1 wherein the portion pressing against the area of the seventh cervical vertebra is stiffer than the other portions of the pillow.

3. The pillow of claim 1 further comprising fastening means for holding said wing portions in place when wrapped around the respective sides of the head of the user.

4. The pillow of claim 1 wherein said wing portions include speed recesses to receive the ears of the user therein.

5. The pillow of claim 1 which is symmetrical about a plane passing between its upper and lower surface and of a unitary solid foamed polyurethane.

6. A generally rectangular, flexible, resilient, elastomeric foam pillow having a top edge, a bottom edge, two side edges, an upper surface, and a lower surface, a semi-circular first cutout portion extending from midway of said top edge into the central portion of the pillow, said first cutout portion being shaped to fit loosely around the back of a human head; and a pair of semi-oval spaced second cutout portions, a spinal portion generally midway of said bottom edge spanning between said second cutout portions and terminating adjacently above said bottom edge, said second cutout portions being smaller in size than said first cutout protion and fitting snugly over human shoulders of a user adjacent the neck and upper spine in a direction from back to front of the human user with the two bottom corners formed by said bottom edge and respective said two side edges being adjacent the chest of the human user, said two bottom corners being forced forwardly by being stretched across the shoulders of a user to cause said spinal portion to be under compression and to apply a force against the cervical area of the back and the adjacent seventh vertebra restraining the spinal discs of the human user.

7. The pillow of claim 6 further comprising fastening means on both sides of said pillow to hold said pillow in place when wrappd around the back and both sides of the human head.

8. The pillow of claim 7 wherein said pillow includes a a pair of spaced recesses for respective ears of the human head.

9. The pillow of claim 6 wherein said spinal support portion is of stiffer material than the remainder of said pillow.

10. The pillow of claim 6 wherein said pillow includes a top surface and a bottom surface, each of said surfaces including a pair of spaced recesses for respective ears of the human head.

11. A flexible resilient pillow to support the cervical area of a user comprising a pair of substantially parallel side edges and top and bottom edges generally parallel to each other, said top edge having a generally semicircular cutout section extending from said top edge toward said bottom edge to accommodate and receive the back of the head of a user, said bottom edge being contoured upwardly toward said top edge in two spaced areas to accommodate and snugly fit over respective shoulders of a user, said side edges and bottom edge defining spaced lower corners of said pillow, a central cervical supporting portion of said pillow spaced between said two areas and spaced above said bottom edge said lower corners being adapted to be disposed adjacent the chest of a user and to forcibly pull against the central portion disposed adjacent the back of the cervical area including the seventh cervical vertebra of the neck of a user whereby increased pressure is applied by said central portion restraining the spinal disc of the user from bulging.

12. The pillow of claim 11 wherein said central portion includes a support member between said two spaced areas and extending from the upper planar surface of said central portion to a thinner tapered end portion spaced from said bottom edge.

13. The pillow of claim 12 wherein said support member is stiffer than the other portions of said pillow.

14. The pillow of claim 12 wherein said support member is tapered from the lower planar surface of said central portion toward said bottom edge.

15. The pillow of claim 11 wherein said two spaced areas are cutout sections, each of said top, bottom and side edges being rounded, each of said cutout sections being rounded.

16. The pillow of claim 12 wherein said pillow includes a generally planar upper surface and a generally planar lower surface substantially parallel to each other, said pillow being substantially symmetrical on either side of a plane passing midway through said pillow and perpendicular to said upper and lower surfaces.

17. The pillow of claim 16 wherein said pillow includes generally parallel and planar upper and lower surfaces, said pillow being substantially symmetrical on either side of a plane passing midway through said pillow and parallel to said upper and lower surfaces.

18. The pillow of claim 12 wherein said pillow includes generally parallel and planar upper and lower surfaces, said pillow being substantially symmetrical on either side of a plane passing midway through said pillow and parallel to said upper and lower surfaces.

19. The pillow of claim 18 wherein said pillow includes releasable means for selectively holding said pillow in a wrapped condition about the back of the neck and sides of the head of a user, said pillow adjacent the ears of a user having recesses in at least one of said upper and lower surfaces for accommodating and receiving the ears of a user.

* * * * *